United States Patent [19]

Naka

[11] 4,244,443

[45] Jan. 13, 1981

[54] DRAWER TYPE EMERGENCY ESCAPE

[75] Inventor: Hiromitsu Naka, Yashio, Japan

[73] Assignee: Kabushiki Kaisha Naka Gijutsu Kenkyusho, Hokkaido, Japan

[21] Appl. No.: 896

[22] Filed: Jan. 4, 1979

[30] Foreign Application Priority Data

Nov. 2, 1978 [JP] Japan ..... 53-135415

[51] Int. Cl.[3] ..... E06C 9/10; E06C 5/24

[52] U.S. Cl. ..... 182/84; 182/77; 182/100; 182/189; 182/195; 280/166

[58] Field of Search ..... 182/83, 84, 88, 77, 182/78, 115, 100, 195, 156, 189; 280/166, 163, 165

[56] References Cited

U.S. PATENT DOCUMENTS

| | | | |
|---|---|---|---|
| 43,283 | 6/1864 | Ballentine | 182/87 |
| 3,341,223 | 9/1967 | Wampfler | 182/88 |
| 3,796,456 | 3/1974 | Bergeson | 182/88 |
| 3,999,627 | 12/1976 | Naka | 182/100 |
| 4,079,812 | 3/1978 | Naka | 182/100 |

*Primary Examiner*—Reinaldo P. Machado

*Attorney, Agent, or Firm*—Wenderoth, Lind & Ponack

[57] ABSTRACT

A drawer type emergency escape is constituted by a stowage box attached to a support, a slidable frame normally received in the stowage box and extended out of the stowage box as the escape is employed, and a shift mechanism for pulling the slidable frame out of the stowage box as the escape is employed. An extensible escape device is connected to the slidable frame, is normally received in the frame for extending out of the frame as the escape is employed and comprises a plurality of telescopically connected pipe sections of different cross-sectional areas.

17 Claims, 19 Drawing Figures

DRAWER TYPE EMERGENCY ESCAPE

BACKGROUND OF THE INVENTION

This invention relates to a drawer type emergency escape adapted to be mounted on buildings, ships, article hoisting and transporting machines employed in factories, harbours, iron works mills, shipbuilding yards and mines, construction machines employed in earth-moving sites, mining machines employed in mines and other large size machines and equipment.

Hitherto, there has been used as an emergency escape system for a multi-story building an escape chute, a rope ladder, an escape rope or the like and this has been installed in a box at the point in a room adjacent to the window or emergency exit thereof. When it is to be employed, it must be taken out of a storage box and thrown down through the window or exit and persons on the ground must secure the lower end of the escape system by any suitable means. Thereafter, the evacuees can escape to the safer ground. Thus, the conventional escape system requires a relatively long time for its preparation for use and, in addition, is not able to give simultaneous and quick refuge to a number of evacuees.

Evacuating by a chute simply suspended from the room where an emergency such as fire occurs has been tried, but it tends to be limited with respect to the height of the building where it can be employed and, therefore, it cannot be installed on a large multi-story building.

There has been used an emergency stairway such as a stationary ladder provided outside of the building. However, when such a stairway is provided, the exit door should be locked in order to prevent an intrusion of thieves, etc. and various articles tend to be placed adjacent to the exit door. Thus, when an emergency occurs, the door cannot be quickly opened, with the result that many casualties have occurred.

Such emergency stairway is known to be a relatively effective installation, except for its imperfect maintenance. However, the scale and installation position are determined relative to the surrounding buildings and the road condition rather than from the standpoint of the safety of the people in the building where it is installed, because it is normally installed in a manner in which it projects from the building wall. In addition, such a stairway for a multi-story building is a large-scale structure and, therefore, lacks a sense of beauty.

In order to avoid such incidents, an emergency escape has been proposed which is adapted to be normally contained in an opening of the building wall so as to constitute a part of the building wall and on emergency to be swung down so as to form a veranda permitting evacuation. However, there are many problems to be solved in connection therewith, such as operation for evacuation, operating performance and durability with respect to natural conditions.

Article hoisting and transporting machines, construction machines and mining machines each generally has the cab disposed in a position substantially above the ground, but the usually equiped with no emergency escape. Of late, large passenger planes each is equiped with an emergency evacuation chute which is adapted to spread and extend upon being filled with an incombustible gas under pressure in a brief time to thereby form an evacuation path through which passengers can evacuate from the plane to the ground. However, this type of evacuation chute has to be extended downwardly until the lower end of the chute reaches the ground and thus, the evacuation chute encounters difficulties in mounting the chute on article hoisting and transporting machines, construction machines and mining machines.

SUMMARY OF THE INVENTION

Therefore, one object of the present invention is to provide a drawer type emergency escape which can effectively eliminate the disadvantages inherent in the conventional evacuation devices.

Another object of the present invention is to provide a drawer type emergency escape which can be standardized and which is therefore applicable to mass production in a factory.

Another object of the present invention is to provide a drawer type emergency escape which can be easily and simply mounted on newly built and existing buildings, ships, article hoisting and transporting machines, construction machines, mining machines and other large size machines.

Another object of the present invention is to provide a drawer type emergency escape which can communicate between higher and lower areas to form an evacuation path therebetween without the necessity for fixedly securing the lower end thereof to any structure.

Another object of the present invention is to provide a drawer type emergency escape which is easy to manipulate and is safe, rapid and positive to operate.

Another object of the present invention is to provide a drawer type emergency escape which allows a number of persons to evacuate in a brief time and which maintains a stabilized position even under gusts of wind, to thereby assure safe evacuation of the persons.

BRIEF DESCRIPTION OF THE DRAWINGS

The above and other objects and attendant advantages of the present invention will be more readily apparent to those skilled in the art from the following description when read in connection with the accompanying drawings, in which.

DETAILED DESCRIPTION OF THE INVENTION

Figure 1:
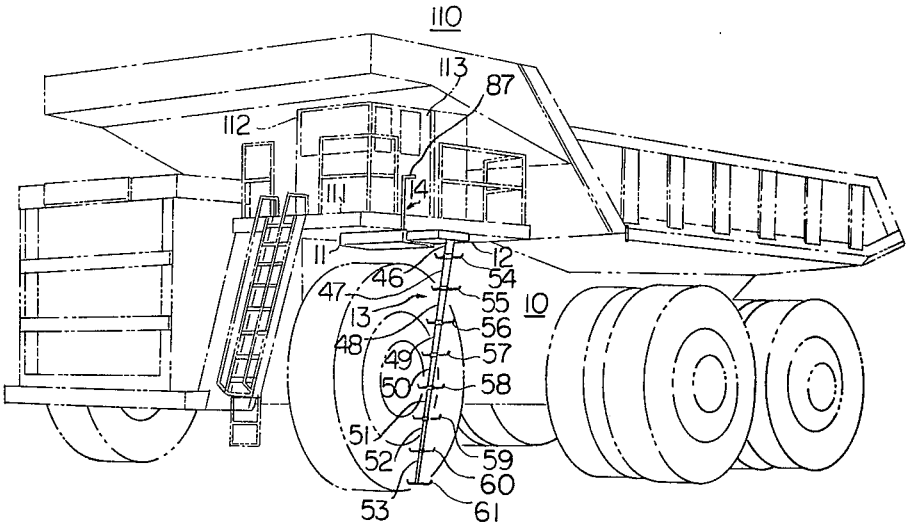
FIG. 1 is a perspective view of one embodiment of the drawer type emergency escape of the present invention mounted on the cab floor of a super-large size dump truck showing the escape in its operative position.
Figure 2:
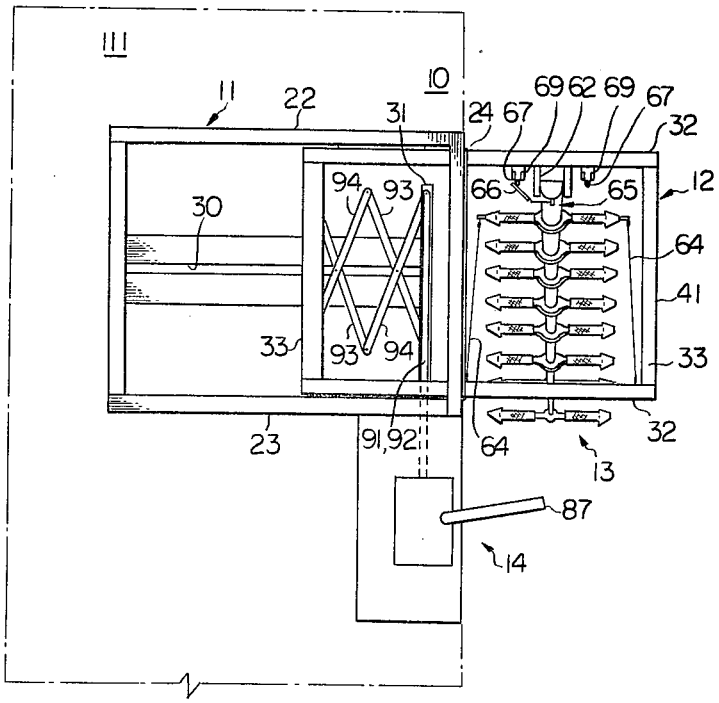
FIG. 2 is a top plan view on an enlarged scale of the drawer type emergency escape as shown in FIG. 1.

The present invention will now be described referring to the accompanying drawings and more particularly, to FIGS. 1 through 16 in which the first embodiment of the drawer type emergency escape constructed in accordance with the present invention is shown. The emergency escape is generally shown with reference numeral 10 and applied to a super-large size dump truck 110.

The drawer type emergency escape 10 is adapted to be mounted on a suitable support portion of the dump truck 110. In FIG. 1, the emergency escape is attached to the cab floor 111 which is positioned on the forward portion of the truck and supports the cab 112 thereon and more particularly, the emergency escape is attached to the underside of the cab floor 111 in a position adjacent to the side edge of the cab floor 111 where the cap 112 is provided with the access door 113.

The drawer type emergency escape 10 comprises a rectangular stowage box 11 secured to the underside of the cab floor 111 by means of set screws with one open end thereof in alignment with the above-mentioned side edge of the cab floor, a rectangular slidable frame 12 for slidable movement between a first or retracted position in which the frame is stored in the stowage box 11 and a second or extended position in which the frame emerges partially out of the box, an extensible escape means 13 and a shift mechanism 14 adapted to extend the slidable frame 12 out of the stowage box 11 when the emergency escape is employed and to retract the slidable frame into the stowage box when the emergency escape is not employed.

The stowage box 11 is secured to the underside of the cab floor 111 by means of screws so as to position the opening 24 at the open end thereof right below the above-mentioned side edge of the cab floor.

Figure 3:
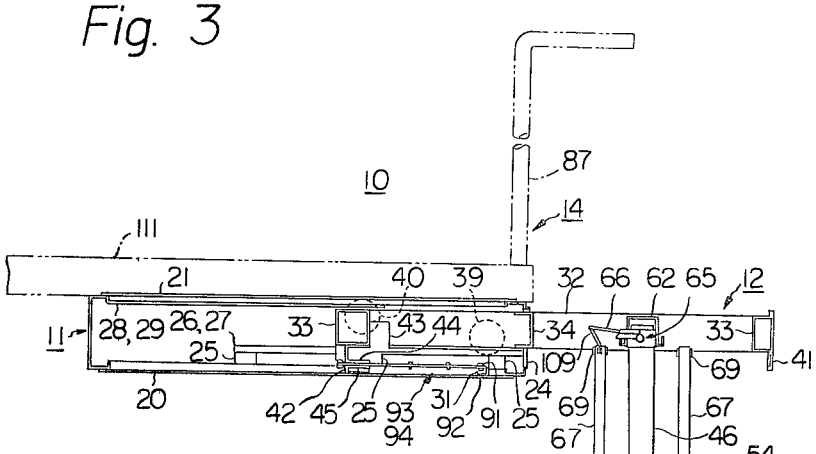
FIG. 3 is a fragmentary sectional view on a further enlarged scale of the drawer type emergency escape as seen from the front of the dump truck of FIG. 1.
Figure 7:
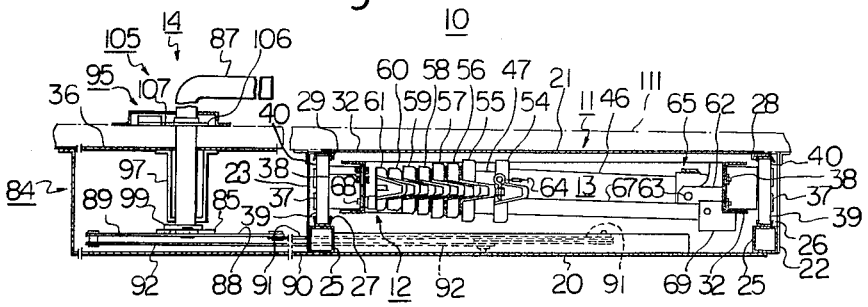
FIG. 7 is a cross-sectional view taken along substantially the line 7—7 of FIG. 5.
Figure 8:
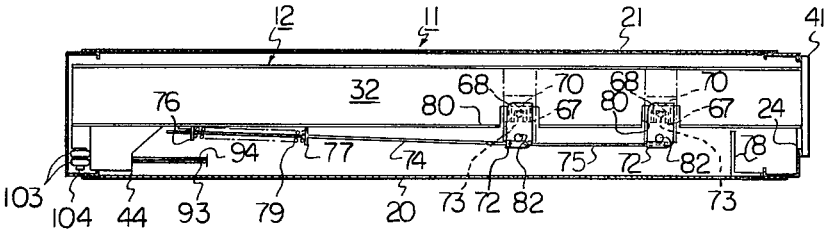
FIG. 8 is a front elevational view on an enlarged scale of the hook-stopper mechanism employed in the drawer type emergency escape as shown in FIG. 1 showing the mechanism in its locked position.

As more clearly shown in FIGS. 3 and 7, the stowage box 11 includes a pair of lower guide rails 26, 27 extending along the opposite and spaced side walls 22, 23, respectively, and secured to the inner surface of the bottom wall 20 with spacers 25 interposed therebetween and a pair of upper guide rails 28, 29 extending along the side walls 22, 23, respectively, and secured to the inner surface of the top wall 21 in opposition to the lower guide rails 26, 27, respectively.

Furthermore, as more clearly shown in FIGS. 3 through 7, the stowage box 11 comprises a tong guide groove means 30 extending in the direction of slidable movement of the slidable frame 12 and secured to the inner surface of the stowage box bottom wall 20 for guiding the extensible tongs of the shift mechanism 14 and a ring guide groove means 31 extending in a intersecting the direction of slidable movement direction of the slidable frame 12 adjacent to the opening 24 and secured to the inner surface of the stowage box bottom wall 20 for guiding the operation links 91, 92 of the shift mechanism 14.

The stowage box 11 further comprises the stopper 78 of the hook-stopper mechanism 71 for a pair of escape means support bars 67 of which description will be made hereinafter referring to FIGS. 3 through 7. The stopper 78 is disposed on the inner surface of the stowage box bottom wall 20 and one of a pair of side frame members 32 (the one side frame member will be referred to as "first side frame" hereinafter) of the slidable frame 12 adjacent to the opening 24 in the stowage box 11.

The slidable frame 12 comprises the pair of side frame members 32 and a pair of cross frame members 33 extending at right angles to the side frame members and each secured at the opposite ends thereof to the associated ends of the side frame members to form a rectangular structure. A reinforcing cross frame member 34 extends between and is secured at the opposite ends thereof to the side frame members 32 intermediate between the cross frame members 33.

Front and rear brackets 35 and 36 are provided and outwardly extend in different heights in spaced positions along the outer surface of each of the side frame members 32, front and rear pins or stub shafts 37 and 38 extend outwardly of the brackets 35, 36, respectively, and lower and upper rollers 39 and 40 are rotatably mounted on the stub shafts 37, 38, respectively and one freely received in the lower and upper guide rails 26, 27 and 28, 29, respectively, whereby the slidable frame 12 can slidably move relative to the stowage box 11.

The slidable frame 12 further has a stopper plate 41 secured to the front end face thereof so that when the slidable frame 12 is fully retracted into the stowage box 11, the stopper plate 41 closes the opening 24 in the stowage box to seal the stowage box.

The frame member 12 further comprises a horizontal guide slit 42 below the rear cross frame member 33.

The horizontal guide slit 42 is defined by an upper channel member 44, secured to a bracket 43 which is in turn secured to and extends downwardly of the rear cross frame member 33, and a lower plate 45 secured to the bracket and opposed to and spaced from the upper channel member. The slit 42 functions as a projection which normally holds the rear ends of the extensible tongs 93, 94 for guiding in the horizontal direction and is adapted to engage the rear ends of the tongs when the slidable frame 12 has been fully extended out of the stowage box 11 by the shift mechanism 14.

As more clearly shown in FIGS. 3 through 7, the escape means 13 is attached to the slidable frame 12 through brackets 62, 62 which are in turn secured to the inner side of the other of the pair of side frame members 32 (the side frame member will be referred to as "second side frame member" hereinafter) and is adapted to be telescopically reduced in length as the frame 12 is retracted into the stowage box 11 and telescopically extended in length as the frame 12 is extended out of the stowage box 11. As the escape means 13 is telescopically extended in length, the inclination angle of the escape means 13 with respect to the slidable frame 12 is regulated by a pair of wire ropes 64.

The escape means comprises eight slidable pipes 46, 47, 48, 49, 50, 51, 52 and 53 of elliptical cross-section which are telescopicaly connected and reduced in cross-sectional area in the above order, and rungs 54, 55, 56, 57, 58, 59, 60 and 61 which are attached to the lower ends of the pipes 46, 47, 48, 49, 50, 51, 52 and 53, respectively, and which extend transversely of the respectively associated pipes. The topmost or largest cross-sectional area slidable pipe 46 is rotatably mounted on the brackets 62 through a support shaft 63 which extends transversely between and is supported at the opposite ends thereof in the brackets 62. Thus, as the slidable frame 12 is extended out of the stowage box 11, the escape means 13 is allowed to telescopically extend until the rung 61 on the lowermost slidable pipe 53 contacts or is positioned closely adjacent to the ground whereby the escape means 13 is suspended from the slidable frame 12.

Figure 4:
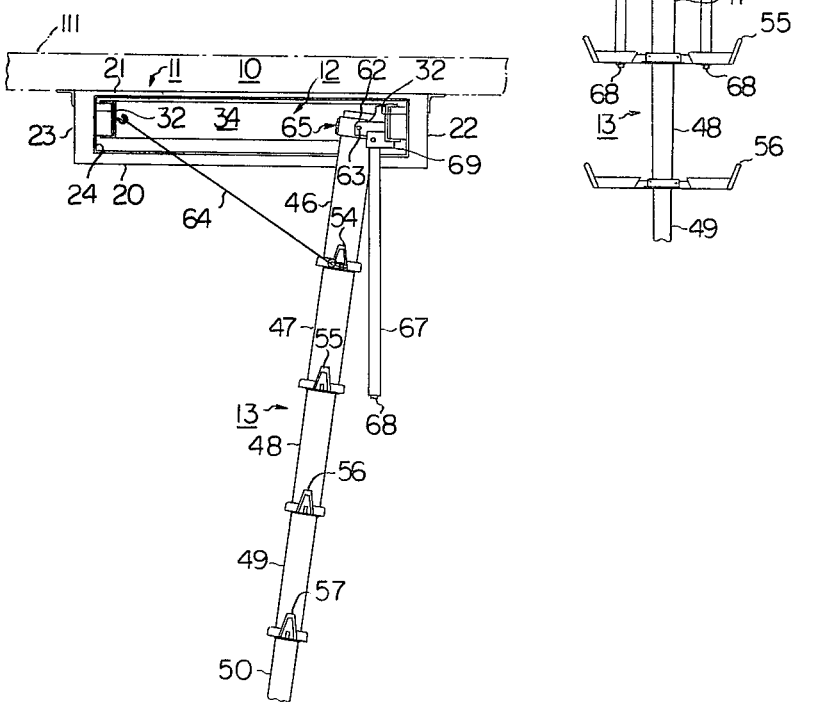
FIG. 4 is a fragmentary sectional view on an enlarged scale of the drawer type emergency escape as seen from one side of the dump truck of FIG. 1.

The slidable pipes of different cross-sectional areas 46, 47, 48, 49, 50, 51, 52 and 53 are so telescopically connected to each other that when the escape means 13 is employed, the uppermost pipe 46 is rotated about the shaft 63 in the counter-clockwise direction as seen in FIG. 4 and the pipes 47, 48 . . . 53 are allowed to slidably extend out of the respectively adjacent upper pipes 46, 47 . . . 52 by their gravity and when the escape means is not employed, the pipes 47, 48 . . . 53 are slidably received into the respectively adjacent upper pipes 46, 47 . . . 52, and the uppermost pipe 46 is rotated about the shaft 63 in the clockwise direction as seen in FIG. 4 until the escape means 13 assumes the horizontal position and is received within the slidable frame 12.

In order to extend and retract the escape means 13, the escape means includes a manual hoist 65 mounted in an upper portion of the uppermost pipe 46. The manual hoist 65 includes a drum (not shown) having a ratchet mechanism (not shown), a wire rope (not shown) having one end anchored to the drum and the other end anchored to the lowermost pipe 53 to the wound about and payed out of the drum and a brake device (not shown) which comprises a fly weight and a friction plate.

The manual hoist 65 further includes an operation lever 66 operatively connected to one of the escape means support bars 67 through a hook bar 109. Thus, when the slidable frame 12 is extended out of the stowage box 11, the hook-stopper mechanism 72 is driven to release the leading or free ends of the escape means support bars 67 from the second side frame member 32 of the slidable frame 12 to allow the support bars 67 to swing downwardly. In response to the downward swinging movement of the escape means support bars 67, the operation lever 66 operates to release the ratched mechanism of the hoist 65 to allow the escape means 13 to extend downwardly toward the ground by gravity. The downward movement speed of the escape means 13 is controlled by the action of the brake device.

When the extended escape means 13 is to be pulled up or retracted into the slidable frame 12, the drum of the hoist 65 is rotated by a handle (not shown) in the wire rope winding-up direction to cause the pipes 47, 48 . . . 53 to be telescopically or slidably received into the respectively adjacent upper pipes 46, 47 . . . 52.

When the slidable frame 12 is received in the stowage box 11, the pair of escape means support bars 67 hold the escape means 13 in the horizontal position within the slidable frame. When the slidable frame 12 is pulled out from the stowage box 11, the pair of escape means support barts 67 are disengaged from the slidable frame 12 and more particularly, from the second side frame member 32 of the frame 12 by the hook-stopper mechanism 71 to be allowed to swing downwardly. The downward swinging movement of the support bars 67 operates the operation lever 66 which in turn releases the ratchet mechanism of the hoist 65 by means of the hook bar 109. As shown in FIGS. 3 through 7, each of the escape means support bars 67 comprises a channel member having a U-shaped cross-section and attached to the second side frame member 32 of the slidable frame 12 by means of the associated bracket 69. Each of the support bars 67 is formed at the leading or free end with a hook 68 so that the support bar can positively engage or disengage from the associated stopper pin 73 of the hook-stopper mechanism 71.

Figure 12:
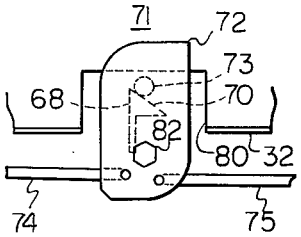
FIGS. 12, 13 and 14 are views showing the rocker plate in different operative positions when the hook on one escape means support bar is locked to the stop pin.
Figure 13:
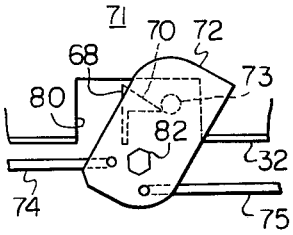
Figure 14:
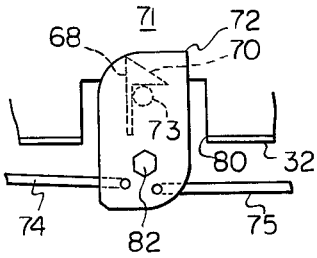
Figure 15:
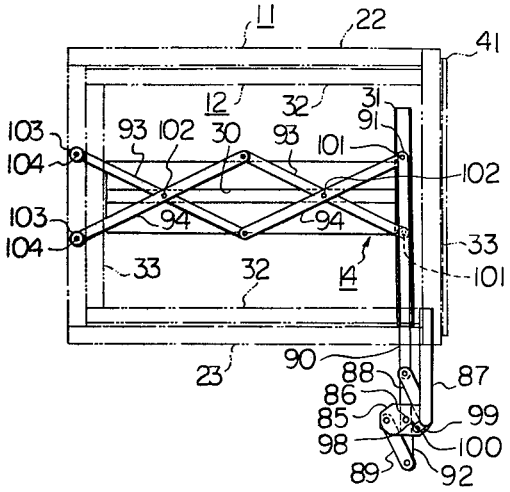
FIG. 15 is a top plan view of the shift mechanism in the drawer type emergency escape as shown in FIG. 1 when the slidable frame is in its retracted position within the stowage box.
Figure 16:
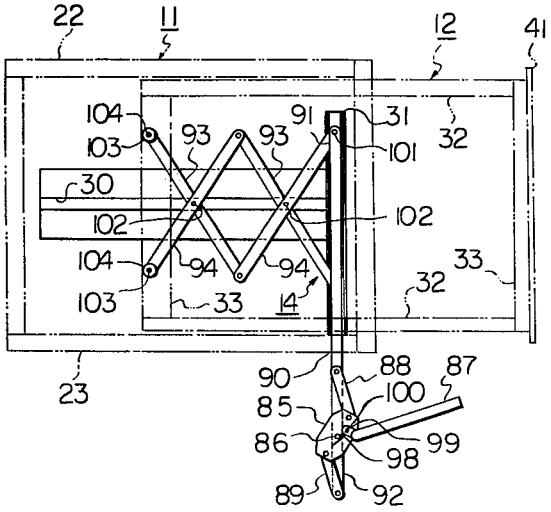
FIG. 16 is similar to FIG. 15, but shows the slidable frame in its extended position in the drawer type emergency escape as shown in FIG. 1.

The hook 68 comprises an angular cross-section member and is provided with a guide face 70 for resetting and as shown in FIGS. 12, 13 and 14, the hook 68 can simply and easily engage the hook-stopper mechanism 71.

As more clearly shown in FIGS. 8 through 14, the hook-stopper mechanism 71 includes a pair of rocking plates 72, 72, stopper pins 73 projecting from the rocking plates 72, a drive bar 74 operatively connected to one of the rocking plates 72, an interlocking bar 75 connected between the rocking plates 72, a guide hanger 76 holding the drive bar 74 for reciprocal movement, the stopper 78 adapted to abut against the flange 77 on the drive bar 74, and a return spring 79 disposed about the drive bar 74 between the flange 77 and guide hanger 76.

The rocking plates 72 are disposed in a pair of notches 80, 80 formed in the first side frame member 32 of the slidable frame 12 and rockably held on brackets 81, 81 on the first side frame member 32 by means of pin bolt-nut means 82, 83.

Furthermore, each of the rocking plates 72 is provided with a stopper pin 73 adapted to engage the hook 68 of the associated escape means support bar 67.

The drive bar 74 has one end hooking on the above-mentioned one rocking plate 72 and the other end extending through a bore (not shown) in the guide hanger 76.

The guide hanger 76 is welded to the underside of the first side frame member 32 of the slidable frame 12 and thus, the other end of the drive bar 74 is reciprocally movable along the associated side frame member 32 relative to the guide hanger 76.

The interlocking bar 75 hooks at the opposite ends thereof to the pair of rocking plates 72 to interlock between the rocking plates so that the rocking plates can rock simultaneously.

Figure 9:
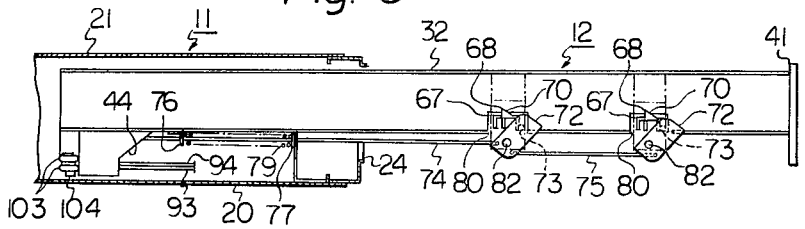
FIG. 9 is similar to FIG. 8, but shows the hook-stopper mechanism in its released position.
Figure 10:
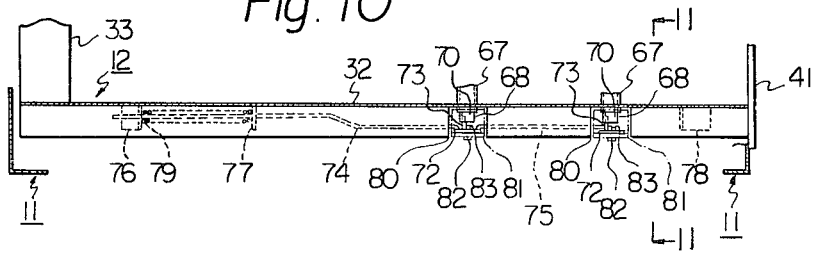
FIG. 10 is a top plan view of the hook-stopper mechanism as shown in FIG. 8.
Figure 11:
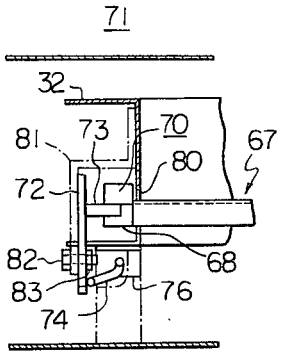
FIG. 11 is a cross-sectional view taken along substantially the line 11—11 of FIG. 10.

When the slidable frame 12 has been fully pulled out of or extended from the stowage box 11, the stopper 78 abuts against the flange 77 on the drive bar 74 to prevent further movement of the drive bar 74 following the movement of the slidable frame 12 in the extending direction as shown in FIG. 9, thus rocking the rocking plates 72 about the respectively associated pin bolts 82 until the hooks 67 on the escape means support bars 67 disengage from the associated stopper pins 73. The stopper 78 is secured to the inner surface of the bottom wall 20 of the stowage box 11 adjacent to the opening 24 in the stowage box.

As more clearly shown in FIGS. 1, 2, 5, 6, 7, 15 and 16, the shift mechanism 14 comprises a rotary plate 85 disposed within a rotary plate case 84 juxtaposed with the stowage box 11, a shift handle 87 adapted to rotate the rotary plate 85 about the pin bolt 86, a pair of connection links 88, 89 pivotally connected to the rotary plate 85, a pair of operation links 91, 92 having first ends pivotally connected to the connection links 88, 89, respectively, and second ends extending through a bore 90 in the stowage box 11 into the interior of the stowage box to be guided along the link guide groove means 31, two sets of extensible tongs 93, 94 disposed within the stowage box 11 to be extended and contracted by the operation links 91, 92 and a locking mechanism 95.

The rotary plate 85 is rotatably mounted on a hat-shaped bracket 97 secured at the top to the top wall 96 of the case 84 by means of pin bolt-nut means (not shown) for rotation in a horizontal plane. The rotary plate 85 is formed with a slot 98 for receiving an eccentric pin 100 on the shift handle 87.

The shift handle 87 has the lower end extending into the case 84 and rotatably held in the case by means of bearings (not shown). The shift handle 87 is formed at the lower end with an arm 99 within the case 84 and the above-mentioned eccentric pin 100 integrally projects from the arm 99 into the slot 98 to be operatively connected to the rotary plate 85.

Pins 101 connected between the operation links 91, 92 and one set of the two sets of extensible tongs 93, 94 and are integrally formed at the lower ends with steps which are guided along the link guide groove means 31. As a result, the operation links 91, 92 are reciprocally movable along the link guide groove means 31.

Pins 102 connect between the tongs 93 and 94 and have at the lower ends steps received in the tong guide groove 30. As a result, the extensible tongs 93, 94 are reciprocally movable along the tong guide groove means 30.

Furthermore, the other set of the two sets of extensible tongs 93, 94 have at the rear ends a pair of rollers 103 rotatably attached thereto by means of pins 104 so that when the tongs 93, 94 are contracted, the rear ends of the tongs engage the upper channel member 44 and the lower plate 45, respectively, through the pins and rollers 104, 103.

The locking mechanism 95 secures the shift handle 87 to the case 84 to thereby hold the slidable frame 12 against the stowage box 11 in both the extended and retracted positions. The locking mechanism 95 comprises a ratchet mechanism 105 including a gear 106, a pawl 107 and a locking spring (not shown) and a foot pedal type release lever adapted to trip the pawl 107 of the ratchet mechanism 105.

Alternatively, the locking mechanism 105 may comprise a disc secured to the shift handle 87 on the upper surface of the cab floor 111, a foot pedal type locking lever disposed on the upper surface of the cab floor 111 for engaging in two notches formed in the disc, both in the extended and retracted positions of the escape means, and a locking spring for operating the locking lever.

When the driver of the dump truck tries to evacuate from the truck to the ground by the use of the drawer type emergency escape 10 as described hereinabove upon the occurrence of any emergency, first of all, the driver steps down on the release lever against the force of the locking spring to release the locking mechanism 95 and then manually pushes the shift handle 87 outwardly to rotate the handle whereupon the eccentric pin 100 on the shift handle 87 rotates the rotary plate 85 about the pin bolt 86 of the hat-shaped bracket 97.

The rotation of the rotary plate 85 contracts the two sets of extensible tongs 93, 94 through the connection links 88, 89 and the operation links 91, 92, whereupon the other set of extensible tongs 93, 94 engage the upper channel member 44 and lower plate 45, whereby the two sets of extensible tongs 93, 94 extend the slidable frame 12 out of the stowage box 11.

When the slidable frame 12 has been fully extended out of the stowage box 11, the stopper 78 abuts against the flange 77 on the drive shaft 74 to prevent further movement of the drive shaft 74 following the movement of the slidable frame 12 in spite of the fact that the slidable frame 12 tends to be extended out of the stowage box 11. Thus, as shown in FIG. 9, the slidable frame 12, and more particularly, the first side frame member 32 and drive bar 74 are out of alignment relative to each other to thereby allow the rocking plates 72 to rotate about the pin bolts 82 as shown in FIG. 9. As a result, the hooks 68 are disengaged from the stopper pins 73 and the escape means support bars 67 swing about the pins on the brackets 69. As a result, the hooks 68 are disengaged from the mechanisms 71 and the escape means support bars 67 swing downwardly about the pins to assume the position as shown in FIGS. 3 and 4.

As the pair of escape means support bars 67 swing downwardly, the escape means 13 also swing downwardly about the stub shaft 63 on the brackets 62 and simultaneously, the support bars 67 operate the operation lever 66 of the hoist 65 through the hook bar 109 to release the ratchet mechanism.

Thus, as shown in FIGS. 1 through 4, the escape means 13 extends downwardly but its own gravity under the control of the brake device.

Thereafter, the driver moves from the cab floor 111 to the escape means 13 to descend down the successively lower rungs 54, 55 . . . 61 to the ground and then evacuates to a safer place.

If and when no defect has been found and the escape 10 functions satisfactorily upon inspection thereof to be conducted after the use of the escape, first, the hoist 65 is manually driven to pull up the extended escape means 13 by means of the wire ropes and the escape means is locked in the raised position.

Next, the slidable frame 12 is retracted into the stowage box 11 and the rocking plates 72 are rotated back to the position as shown in FIG. 12 under the action of the return spring 79. Thereafter, the raised escape means 13 is rotated upwardly about the support stub shaft 63 to the horizontal position and the pair of support bars 67 are rotated upwardly about the respectively associated bolt pins until the resetting guide faces 70 on the hooks 68 come to contact with the stopper pins 73.

As the support bars 67 are further raised, the stopper pins 73 are guided on the resetting guide faces 70 and thus, the rocking plates 72 are rotated forwardly about the bolt pins 82 under the force of the return spring 79 as shown in FIG. 13.

As the support bars 67 are still further lifted, the stopper pins 73 clear the resetting guide faces 70 and thus, as shown in FIG. 14, the rocking plates 72 are rotated backwardly or in the counter-clockwise direction as shown in FIG. 14 about the bolt pins 82 under the force of the return spring 79 and the hooks 68 on the support barts 67 are latched on the stopper pins 73. In this way, the hook stopper mechanism 71 is returned to the initiation position in which the leading or free ends of the support bars 67 are held by the second side frame member 32 of the slidable frame 12 whereby the escape means 13 is retained in the slidable frame 12.

Thereafter, the driver continues to step down on the release lever against the force of the locking spring to release the locking mechanism 95 which in turn releases the shift handle 87 in its free position. With the shift handle 87 maintained in the free position, the slidable frame 12 is fully retracted into the stowage box 11.

Thereafter, the shift handle 87 is rotated in the direction to pull the shift handle inwardly and the release lever is released from the stepping-down force applied by the driver's foot to lock the locking mechanism which in turn locks the shift mechanism 14. At this time, the two sets of extensible tongs 93, 94 are extended by the shift handle 87 through the connection links 88, 89 and operation links 91, 92.

Figure 5:
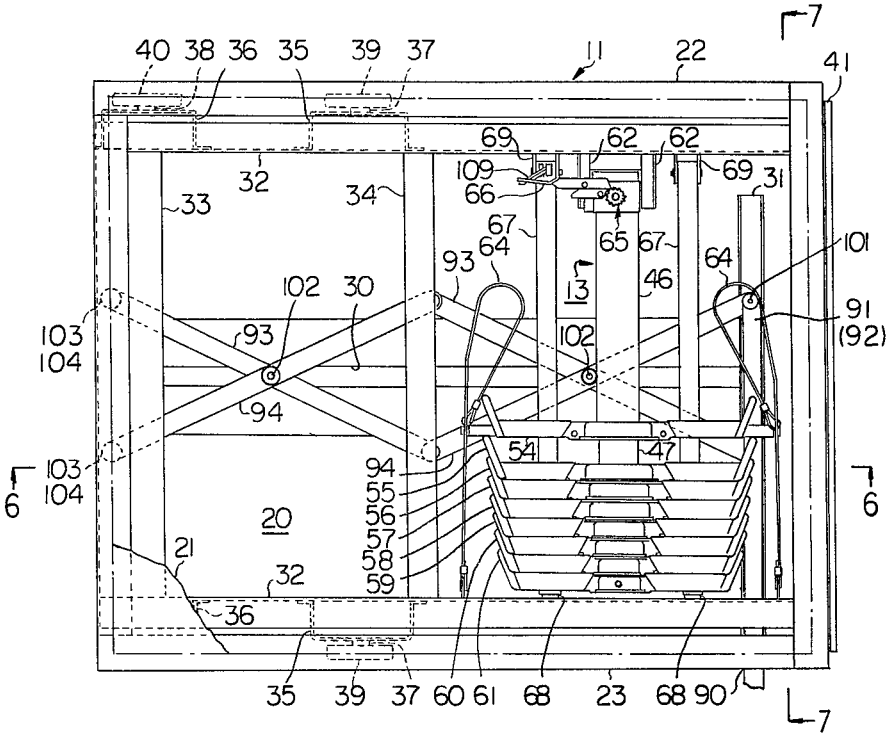
FIG. 5 is a top plan view on an enlarged scale of the drawer type emergency escape as shown in FIG. 1 showing the same in its storage or retracted position with the top wall of the stowage box being partially cut away.
Figure 6:
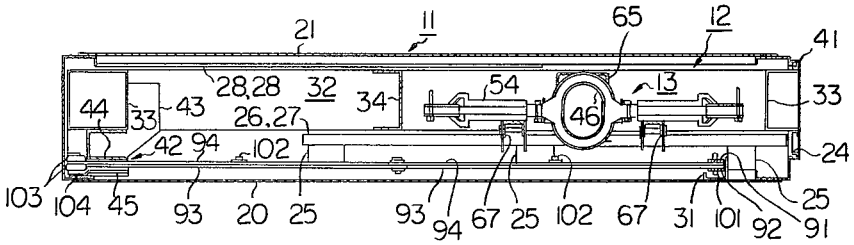
FIG. 6 is a cross-sectional view taken along substantially the line 6—6 of FIG. 5.

By the above-mentioned operation procedure, the slidable frame 12 is retracted into the stowage box 11 and locked to the stowage box whereby the emergency escape 10 is returned to the position as shown in FIGS. 5, 6 and 7.

Figure 17:
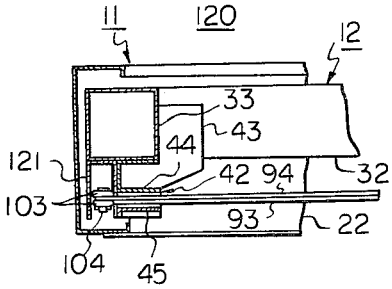
FIG. 17 is a fragmentary cross-sectional view of a second embodiment of the drawer type emergency escape of the present invention mounted on the cab floor of the super-large size dump truck.

FIG. 17 shows another embodiment of the drawer type emergency escape 120 of the present invention as being mounted on a super-large size dump truck.

The drawer type emergency escape 120 is substantially similar to the drawer type emergency escape 10 as described referring to FIGS. 1 through 16 except that a tong stopper plate 121 is additionally provided at the inner or rear end of the slidable frame 12.

The tong stopper plate 121 comprises a channel member of U-shaped cross section and is attached to the underside of the inner cross frame member 33. The tong stopper plate 121 is adapted to receive and confine therein the metal rollers 103 at the rear ends of the other set of tongs 93, 94 therein and also to guide the rollers along the channel defined by the channel member 121.

By the provision of the tong stopper plate 121 on the inner cross frame member 33, the slidable frame 12 can be easily extended out of and retracted into the stowage box 11 by the operation of the shift handle 87.

Thus, as compared with the afore-mentioned drawer type emergency escape 10, the drawer type emergency escape 120 makes the storage of the slidable frame 12 and the function of the components of the escape more convenient.

Figure 18:
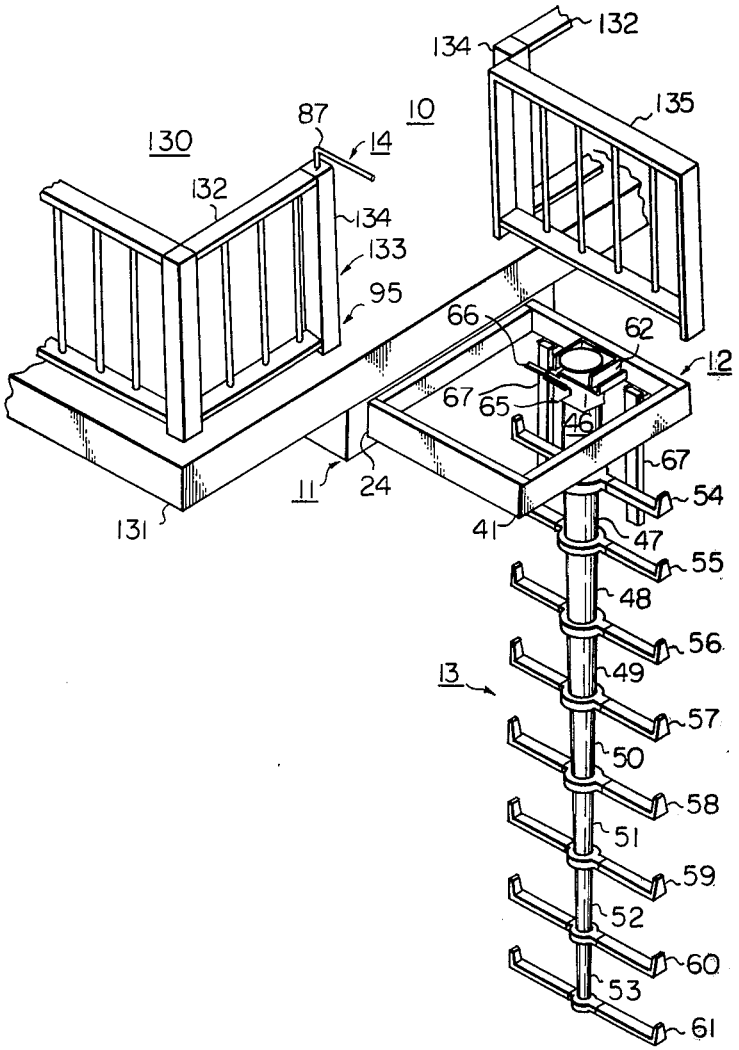
FIG. 18 is a perspective view of the drawer type emergency escape as shown in FIG. 1 in its operative position when the escape is mounted on the veranda of the second floor of a multi-story building.

FIG. 18 schematically shows the drawer type emergency escape 10 of the invention as being applied to a multi-story building 130.

The emergency escape 10 is attached to the veranda 131 of the second floor of the building 130 so that occupants in the second floor can evacuate to the ground. The emergency escape 10 is, of course, mounted on the veranda 131 by attaching the stowage box 11 to the underside of the veranda 131 in the same manner as that for mounting the emergency escape on the cab floor 111 of the dump truck.

In the mounting of the emergency escape 10 on the second floor veranda 131 of the building, the shift handle 87 is extended into and secured to one of the pillars 134 which define an emergency exit 133 in the railing 132.

When occupants on the second floor try to escape from the second floor to the ground by way of the emergency escape 10 upon the occurrence of a fire, first of all, any one of them opens the railing door 135 which normally closes the emergency exit 133 in the railing 132 and then steps down the release lever against the force of the locking spring to release the locking mechanism 95. Thereafter, any one of the occupants pushes the shift handle 87 outwardly to rotate the handle with the locking mechanism 95 maintained in the released position.

As the shift handle 87 is rotated in this way, the slidable frame 12 is extended out of the stowage box 11 and the escape means 13 is allowed to extend downwardly from the slidable frame 12 to the ground in the same manner as described in connection with the emergency escape 10 mounted on the dump truck 110.

Thus, the occupants can evacuate from the second floor veranda 131 to the ground by descending the successive rungs 54, etc., of the escape means 13 and then to a safer place.

When it has been found that the emergency escape 10 has no defect and still functions normally through inspections to be conducted after the use of the emergency escape, the escape means 13 is pulled up or retracted into the slidable frame 12 and the slidable frame 12 is then retracted into the stowage box 11 following the same procedure employed in the case in which the emergency escape 10 is mounted on the dump truck 110, whereby the emergency escape 10 assumes its initial position.

Figure 19:
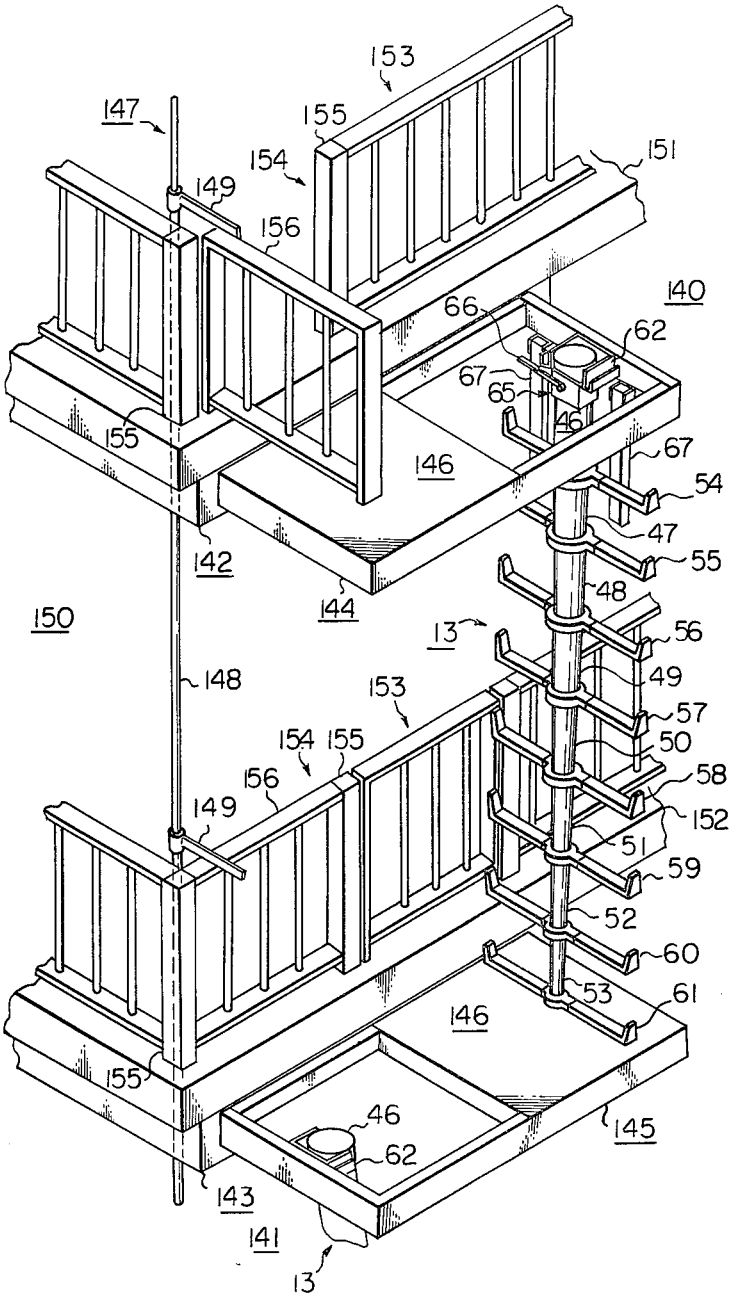
FIG. 19 is a perspective view of a modified drawer type emergency escape of the present invention in its operative position when the escape is mounted on the veranda of each floor of a multi-story building such as a mansion or apartment house.

FIG. 19 schematically shows modified emergency escapes 140, 141 of the present invention mounted on selected two floors of a multi-story building such as a mansion.

The modified emergency escapes 140, 141 are mounted on the verandas 151, 152 of the two selected floors of the multi-story building in such a manner that the escape 140 is mounted on the veranda 151 of the upper floor and the emergency escape 141 is mounted on the veranda 152 of the floor positioned right below the upper floor to provide an escape path from the upper floor to the floor positioned right below the second-mentioned floor or the ground.

The emergency escapes 140, 141 are substantially similar to the embodiment as described hereinabove in connection with FIGS. 1 through 16 except that the slidable frame and the shift handle and release lever of the shift mechanism are modified.

That is, the slidable frames 144 and 145 of the emergency escapes 140 and 141, respectively, have added thereto landings 146. The escape means 13 adapted to be extended out of and retracted into the slidable frame 144 and landing 146 in the emergency escape 140 association with the upper floor and the corresponding parts of the emergency escape 145 associated with the lower floor are staggered with respect to each other, so that the escape means of the escape 140 can extend down to the landing 146 of the escape 141.

In order to cope with the construction of the slidable frames 144, 145 of the modified emergency escapes 140, 141, respectively, the stowage boxes 142, 143 of the emergency escapes 140, 141, respectively, are formed larger than the stowage box 11 of the emergency escape 10.

Since the two emergency escapes 140, 141 associated with the verandas 151, 152 of the two selected floors are identical with each other except for the disposition of the escape means 13 and landing 146, description will be made of only one of the two escapes 140 with the understanding that the description of one escape can be equally applied to the other escape. The shift mechanism 147 of the emergency escape 140 is constituted by an interlocking shift rod 148 which extends through the veranda 151 and rotary plate case 84 so that the shift handle 87 of the afore-mentioned emergency escape 10 can be commonly employed in the emergency escapes 140, 141 and the interlocking shift mechanism 147 has an operation handle 149 mounted thereon.

The release levers of the shift mechanisms 147 of the two emergency escapes are connected together by means of an interlocking rod (not shown). Like the interlocking shift rod 148, the interlocking rod extends through the verandas 151, 152 of the two floors and the rotary plate cases 84 of the two escapes.

With the drawer type emergency escapes 140, 141 of the above-mentioned construction mounted on the verandas 151, 152 of the two floors, when an emergency such as a fire occurs on the floor associated with the veranda 151 of a multi-story building, the occupants on the floor can evacuate from the floor to the next lower floor or floors or the ground by way of the emergency escape or escapes. That is, any one of the occupants on the floor where the fire occured steps down the release lever of the shift mechanism 147 positioned on the veranda 151 of the floor, trips the locking mechanism of the shift mechanism 147 associated with the floor right below the floor and pushes the operation handle 149 outwardly to rotate the interlocking shift rod 148.

As the interlocking shift rod 148 is rotated, the emergency escapes 140, 141 on the verandas 151, 152 are actuated to extend the slidable frames 144, 145 out of the stowage boxes 142, 143, respectively, of the emergency escapes 140, 141, whereby the escape means 13 of the escape 140 is allowed to extend downwardly to the landing 146 formed on the slidable frame 145 of the escape 141 associated with the lower floor and the escape means 13 of the lower floor escape 141 is also allowed to extend downwardly to the floor right below the lower floor or the ground.

Thus, the occupants on the first-mentioned floor move from the veranda 151 onto the landing 146 of the slidable frame 144 by opening the railing door 156 which normally closes the emergency exit 154 in the railing 153, transfer from the landing 146 onto the escape means 13 of the escape 140 and descend down the successive rungs 46, 47 . . . 53 to the landing 146 of the slidable frame 145 of the escape 141 associated with the lower floor. By repeating the procedure, the occupants can transfer to the emergency escapes associated with the successive lower floors one after another to a safer place on the ground.

In inspections to be conducted after the extinction of the fire, if it has been found that each of the emergency escapes 140, 141 has no defect and functions normally, following the same procedure as described in connection with the embodiment as shown in FIGS. 1 through 16, the escape means 13 of the escapes 140, 141 associated with the different floors of the multi-story building are pulled up and retracted into the slidable frames 144, 145, respectively, the release lever of the escape associated with any one floor is stepped down to simultaneously release the locking mechanisms of the escapes associated with all the floors, the operation handle 149 of the escape associated with the one floor is pulled inwardly to rotate the interlocking shift rods 148 of the escapes associated with all the floors, and the slidable frames 144, 145 of the escapes associated with all the floors are retracted into the stowage boxes 142, 143, respectively, whereby the escapes 140, 141 associated with all the floors assume their initial positions.

With the above-mentioned construction and arrangement of the components of each of the embodiments, since the slidable frame having the extensible escape means attached thereto is adapted to be slidably received into and extended out of the associated stowage by means of the shift mechanism, the escape can be standardized and applicable to mass production in a factory. The escape can be easily mounted on newly built and existing buildings, ships, article hoisting and transporting machines, construction machines, mining machines and other large size machines and equipment. In addition, an evacuation path communicating between an area and an area right below the upper area can be formed without fixedly securing the lower end of the escape means to a structure. The escape is easily manipulated and safe, rapid and positive in operation. The escape can be set in a brief time and allows a number of persons to evacuate in a brief time. Finally, the escape can maintain its stabilized position even under a gust of wind to thereby assure safe evacuation of persons therethrough without causing the persons to have fear.

While preferred embodiments of the invention have been shown and described in detail, it will be understood that the same are for illustration purpose only and not to be taken as a definition of the invention, reference being had for this purpose to the appended claims.

What is claimed is:

1. A drawer type emergency escape comprising:

a stowage box adapted to be attached to a support;

a slidable frame mounted to be slidably extended out of and retracted into said stowage box;

a telescopically extensible escape means attached to said slidable frame to be received into and extended out of the frame; and a shift mechanism adapted to pull said slidable frame out of said stowage box as said emergency escape is employed and including a support shaft fixed to a side of said stowage box, a rotary plate rotatably mounted on said support shaft and operable from the outside of said stowage box, a pair of connection links connected at first ends thereof to said rotary plate, a pair of operation links connected at first ends thereof to second ends of said connection links, extensible tongs connected at first ends thereof to second ends of said operation links and having second ends adapted to engage said slidable frame, and a ring guide groove guiding said operation links in a direction extending at right angles to the direction of extension of said slidable frame.

2. A drawer type emergency escape as claimed in claim 1, wherein said shift mechanism further includes a shift handle rotating said rotary plate about said support shaft.

3. A drawer type emergency escape as claimed in claim 2, wherein said shift mechanism further includes a tong guide groove guiding said extensible tongs in said direction of extension of said slidable frame.

4. A drawer type emergency escape as claimed in claim 2, wherein said shift mechanism further includes a locking mechanism holding said slidable frame in the extended position thereof.

5. A drawer type emergency escape as claimed in claim 4, wherein said locking mechanism includes a gear fixed to said shift handle, a pawl rotatably mounted on said side of the stowage box through a pin, and a locking spring normally locking said pawl to said gear.

6. A drawer type emergency escape as claimed in claim 4, wherein said locking mechanism includes a disc fixed to said shift handle, a foot pedal type locking lever disposed on said support for engaging in a plurality of notched grooves formed in said disc, and a locking spring for locking said locking lever to said notched grooves.

7. A drawer type emergency escape as claimed in claim 7, further comprising a pair of lower guide rails disposed within said stowage box and extending along one side wall of said stowage box, and a pair of rollers rotatably mounted on a side wall of said slidable frame to be guided along said lower guide rails.

8. A drawer type emergency escape as claimed in claim 7, further comprising a pair of upper guide rails disposed within said stowage box extending along one side wall of said stowage box, and a pair of rollers rotatably mounted on a side wall of said slidable frame to be guided along said upper guide rails.

9. A drawer type emergency escape as claimed in claim 1, further comprising a pair of escape means support bars rotatably mounted at first ends thereof to a first side frame member of said slidable frame for holding said escape means in a horizontal position within said slidable frame as said slidable frame is retracted into said stowage box, and a stopper mechanism for locking second ends of said escape means support bars to a second side frame member of said slidable frame as said slidable frame is retracted into said stowage box.

10. A drawer type emergency escape as claimed in claim 9, wherein said escape means comprises a plurality of telescopically connected pipe sections of different diameters which decrease downwardly, rungs transversely attached to respective said pipe sections at lower ends thereof, and the uppermost said pipe section being pivotally mounted on said sliding frame.

11. A drawer type emergency escape as claimed in claim 10, wherein said escape means further includes a hoist having a wire rope extending through successive said pipe sections and connected at a lower end to the lowermost pipe section of said pipe sections.

12. A drawer type emergency escape as claimed in claim 11, further comprising a hook bar connecting an operation lever operating a ratchet mechanism of said hoist to one of said escape means support bars.

13. A drawer type emergency escape system for installation in a multi-story building and comprising a plurality of escape devices, each escape device having:

a stowage box adapted to be attached to a veranda of a respective story of the building;

a slidable frame mounted to be slidably extended out of and retracted into said stowage box;

a telescopically extensible escape means attached to said slidable frame to be received into and extended out of the frame; and a shaft mechanism adapted to pull said slidable frame out of said stowage box as said emergency escape is employed and including a support shaft fixed to a side of said stowage box, a rotary plate rotatably mounted on said support shaft and operable from the outside of said stowage box, a pair of connection links connected at first ends thereof to said rotary plate, a pair of operation links connected at first ends thereof to second ends of said connection links, extensible tongs connected at first ends thereof to second ends of said operation links and having second ends adapted to engage said slidable frame, and a ring guide groove guiding said operation links in a direction extending a right angles to the direction of extension of said slidable frame.

14. A drawer type emergency escape system as claimed in claim 13, wherein said shift mechanism further includes a shift handle rotating said rotary plate about said support shaft.

15. A drawer type emergency escape system as claimed in claim 14, wherein the shift handle of said shift mechanism for each floor of a multi-story building comprises an interlocking shift rod connected to the shift rod of the shift mechanism for an adjacent floor and an operation handle secured to said interlocking shift rod of the associated shift mechanism for each floor.

16. A drawer type emergency escape system as claimed in claim 15, further comprising a locking mechanism comprising a gear fixed to said interlocking rod for each floor, a pawl rotatably mounted on said side wall of the stowage box by means of a pin for each floor, a spring for locking said pawl to said gear for each floor, and a connection rod connecting said pawls for adjacent floors in the multi-story building.

17. A drawer type emergency escape system as claimed in claim 15, further comprising a locking mechanism comprising a disc fixed to said interlocking rod for engaging a plurality of notched grooves formed in said disc for each floor, and an interlocking rod connecting between said locking levers for adjacent floors.

* * * * *